US007883245B2

(12) United States Patent
Melzner

(10) Patent No.: US 7,883,245 B2
(45) Date of Patent: Feb. 8, 2011

(54) ILLUMINATING SPOTLIGHT

(75) Inventor: Erwin Melzner, Stephanskirchen (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 500 days.

(21) Appl. No.: 11/792,597

(22) PCT Filed: Dec. 7, 2005

(86) PCT No.: PCT/DE2005/002208

§ 371 (c)(1),
(2), (4) Date: May 7, 2008

(87) PCT Pub. No.: WO2006/061006

PCT Pub. Date: Jun. 15, 2006

(65) Prior Publication Data

US 2008/0310175 A1 Dec. 18, 2008

(30) Foreign Application Priority Data

Dec. 7, 2004 (DE) ..... 20 2004 019 160 U

(51) Int. Cl.
*F21V 17/00* (2006.01)

(52) U.S. Cl. ..... 362/370; 362/369; 362/368; 362/362; 362/390; 362/455; 362/440

(58) Field of Classification Search ..... 362/455, 362/362, 288, 306, 457, 390, 548, 549, 364, 362/369, 368, 370, 374, 375, 365, 440
See application file for complete search history.

(56) References Cited

U.S. PATENT DOCUMENTS 1,414,088 A * 4/1922 Kuen ..... 362/374
2,271,162 A * 1/1942 Sorrell ..... 362/374
3,375,368 A * 3/1968 Dorsky ..... 362/306

(Continued)

FOREIGN PATENT DOCUMENTS

DE 1 788 105 5/1959

(Continued)

OTHER PUBLICATIONS

International Search Report, dated Mar. 3, 2006, corresponding to PCT/DE2005/002208.

(Continued)

*Primary Examiner*—Robert J May
(74) *Attorney, Agent, or Firm*—Christie, Parker & Hale, LLP

(57) ABSTRACT

An illuminating spotlight having a spotlight housing and a spotlight device connected to the spotlight housing, in particular a protective screen, spotlight lens or reflector, is provided. The lateral edge of the spotlight device is connected to the spotlight housing via spring elements arranged in a distributed fashion. The spring elements having a fastening lug that is connected to the spotlight housing and from which there are angled away two spring arms which bear against the lateral edge of the spotlight device and are designed to be resilient in a radial direction of the spotlight housing. Spring stops of resilient design are project in an axial direction of the spotlight housing which bear against at least one surface of the spotlight device from the spring arms.

28 Claims, 11 Drawing Sheets

U.S. PATENT DOCUMENTS

| | | | | |
|---|---|---|---|---|
| 3,878,388 | A * | 4/1975 | Germany | 362/374 |
| 4,587,598 | A * | 5/1986 | Burgess et al. | 362/475 |
| 5,091,835 | A | 2/1992 | Malek et al. | |
| 6,101,771 | A | 8/2000 | Aikens | |

FOREIGN PATENT DOCUMENTS

| | | |
|---|---|---|
| DE | 29 51 619 C2 | 7/1981 |
| DE | 87 06 820.6 | 4/1988 |
| DE | 88 06 455.7 | 8/1988 |
| DE | 43 13 073 C2 | 10/1994 |
| DE | 197 57 055 A1 | 6/1999 |
| DE | 203 12 391 U1 | 1/2004 |

OTHER PUBLICATIONS

International Preliminary Examination Report, dated Dec. 2006, corresponding to PCT/DE2005/002208.

* cited by examiner

ILLUMINATING SPOTLIGHT

CROSS-REFERENCE TO A RELATED APPLICATION

This application is a National Phase Patent Application of International Patent Application Number PCT/DE2005/002208, filed on Dec. 7, 2005, which claims priority of German Patent Application Number 20 2004 019 160.1, filed on Dec. 7, 2004.

BACKGROUND

The invention relates to an illuminating spotlight.

DE 203 12 391 U1 discloses a spotlight having a spot-light housing in which a lamp and a reflector and, on the front beam exit opening, a housing frame for holding auxiliary parts such as front lenses, protective glass screens, gratings or the like are arranged.

The arrangement and fastening of these spotlight devices in and on the spotlight housing requires high precision and thus a large outlay on production, particularly with reference to the devices that influence beams, such as reflectors and lenses, since these devices must be arranged centrally in relation to the optical axis of the spotlight.

A further problem consists in that the spotlight devices connected to the spotlight housing are exposed to substantial mechanical and thermal loads from shocks and, particularly in the case of high power spotlights, to a large dissipation of heat by the spotlight lamp. This applies to a large degree to a protective screen made from glass or plastic that is provided on the beam exit side of the spotlight as shock-hazard protection and explosion protection, there also being provided for the purpose of better thermal insulation two protective screens that are axially spaced apart from one another and enclose between them an air space for heat insulation. In this case, it turns out to be problematical, in turn, to ensure the mutual spacing of the protective screens even in the case of high thermal loading and taking account of violent movements of the illuminating spotlight and of shocks exerted on the illuminating spotlight.

An illuminating spotlight having two protective glass screens arranged at the front is disclosed by DE 87 06 820 U, an air space in the form of a gap being provided between a front glass screen and a second protective glass screen made from armored glass, for the purpose of heat insulation and pressure isolation.

For the purposes of simplifying the design, secure fastening of a cover plate and of more easily changing the lamp of a luminaire, DE 43 13 073 C2 discloses a number of springs, bent in a U-shape, for fastening a cover plate on a cambered reflector inside which the lamp is detachably fastened as luminous means, and whose beam exit opening is covered by a cover plate that transmits the beams and is made from glass, plastic or a grating. The outer edge of the reflector has a number of cutouts or openings in which there are fastened springs that engage the front side of the cover plate from behind with the aid of a projection. The free limbs of the spring bent in a U-shape are in this case plugged through the opening in the reflector edge toward the front side of the luminaire and are locked in such that they are self-supporting.

DE 197 57 055 A1 discloses a luminaire having a cylindrical housing, a reflector and a glass holder which is arranged on the front of the housing and has at least one circular glass disk. The glass holder comprises two glass holding springs that are fastened diametrically on the end face of the housing, and have a spring element, formed from spring sheet metal, with an arcuately curved front side, and limbs that adjoin the front side in a U-shaped fashion and whose ends are formed into fastening eyes. The arcuately curved front side of the glass holding springs has in a circumferential direction of the housing longitudinal slots that delimit resilient strips that, in order to form a glass disk mount, are arcuately curved in alternating sequence outward toward the outside of the spring element and inward toward the rear side of the spring element such that the glass disk can be inserted radially into the depressions thereby formed in the glass holding springs. Arranged in addition on the circumference of the housing as protection against glare is a sliding ring that is sprung with respect to the housing of the luminaire and can be displaced via the glass holding springs.

The spring elements are arranged in a distributed fashion on the circumference of the spotlight device, designed resiliently in a radial direction of the spotlight housing, and connected to the spotlight housing via fastening lugs and/or fastening arms. Two spring arms bearing against the lateral edge of the spotlight device are also angled away with the resilient strips.

U.S. Pat. No. 5,091,835 discloses an illuminating spotlight having a cylindrical spotlight housing and having spotlight devices, connected to the spotlight housing, in the form of a reflector, as well as of a front lens and a protective grid. The connection of the spotlight devices to the spotlight housing is performed via spring elements that are designed as V-shaped control spring clips and either bear against the inside of the spotlight housing, or are plugged onto the front edge of the spotlight housing. The spotlight devices are inserted via depressions in the V-shaped control springs, which are designed to be resilient in a radial direction by means of their shape, and form a fastening lug that is connected to the spotlight housing and from which attached spring arms are angled away at the lateral edge of the spotlight device.

U.S. Pat. No. 6,101,771 discloses a fastening for a cover plate that is arranged at the light emission opening of a cylindrical housing of an illuminating device. The fastening device comprises a number of fastening elements that are arranged in a fashion distributed on the circumference of the housing opening, are connected to a housing flange formed at the housing opening, and have a base with a bore through which it is possible to plug a fastening element that connects an outer fastening ring to the housing flange. The fastening elements have two spring arms coming out of the base, whose ends are angled away to form spring stops, and bear with the latter against the cover plate inserted into the gap between the housing flange and the fastening ring, and exert a contact force on the cover plate.

The spring stops of the fastening elements are designed to be resilient in an axial direction, and exert an axial pressing force on the cover plate, but effect no spring elasticity in an axial direction, only serving exclusively to secure the cover plate in the opening gap between the housing flange and the fastening ring.

SUMMARY

The object of the present invention is to connect a spotlight device in the form of a protective screen, lens or reflector to the spotlight housing such that mechanical and thermal loads on the spotlight device are largely avoided, and the precondition for a self-centering alignment of the spotlight device is provided.

In alternative embodiments, the solution according to the invention enables one or more spotlight devices to be connected to a spotlight housing without thermal or mechanical loads, and also enables them to be aligned self-centered in and on the spotlight housing.

Owing to the fact that spring stops that are designed to be resilient in an axial direction of the spotlight housing and that project from the spring arms, bear against at least one surface of the spotlight device, shocks exerted on the spotlight housing are effectively buffered and thermal stresses between the spotlight housing and the spotlight device are avoided. This first refinement of the spring element enables the connection of a single, disk-shaped spotlight device to the spotlight housing, an annular attachment or a projection, directed toward the spotlight interior, on the spotlight housing forms a mating stop for the spring element.

Moreover, as a result of the arrangement of a number of spring elements, a self-centering of the spotlight device with reference to the optical axis of the illuminating spotlight is ensured in the case of cylindrical spotlight housings and an edge region of the spotlight device in the shape of a circular disk.

Suitable for connecting, for example, two protective screens spaced apart from one another axially to the spotlight housing is a spring element whose fastening lug is of U-shaped design with a base and two limbs, two spring arms with spring stops projecting from their ends being angled away from each limb.

In this refinement, the spring elements ensure an axially sprung spacing between two disk-shaped spot-light devices such as protective screens, and at the same time a radial springing of the protective screens that bear in an axial direction against inwardly directed projections or attachments of the spotlight housing or of a lens ring that can be inserted into the spotlight housing.

In order to connect the spring elements to the spot-light housing, the limbs of the fastening lug have bores for holding a fastening element connecting the spring element to the spotlight housing and can comprise, for example, a bolt or a screw connection.

A distributed arrangement of the spring elements at the edge region of the spotlight device, in particular three spring elements arranged offset from one another by respectively approximately 120° at the edge region of the spotlight device, attains a connection of the spotlight device to the spotlight housing that ensures an optimum fastening of the spotlight device for the purpose of protecting against shocks or impacts, as well as a self-centering, for example, of a reflector, with reference to the optical axis of the illuminating spotlight.

For the purpose of resiliently fastening the spotlight device on the spotlight housing, the spring elements can be designed to be resilient in a radial direction or in an axial direction of the spotlight housing, but preferably along two axes, that is to say in a radial and axial direction of the spotlight housing.

Particularly in the case of fastening the spotlight device on the spotlight housing in a resilient fashion along two axes, an optimum protection of the spotlight device against impacts or shocks and against thermal expansions is ensured.

If the spotlight device comprises two protective screens that are spaced apart from one another in an axial direction of the spotlight housing at the beam exit of the spotlight housing, the edge regions of the protective screens rest at the circumference on the spring arms of a spring element with a U-shaped fastening lug, while the spring stops designed as kinked leaf springs determine the axial spacing of the two protective screens from one another, and the edges of the mutually facing surfaces of the protective screens respectively bear against a kink of the spring stops, designed as kinked leaf springs, of the spring elements.

In an exemplary embodiment, the spring arms and the spring stops are designed as leaf springs, in particular as flat, kinked or bent leaf springs.

This refinement of the spring elements enables a simple, cost-effective production in conjunction with high thermal stability and assurance of the resilient properties.

The protective screens are preferably arranged in a lens ring connected to the spotlight housing, and the spring elements arranged between the protective screens press the edge regions of the protective screens against the lens ring.

In a further exemplary embodiment, the spring elements comprise coil springs that are arranged between a spring element or holding element connected to the spotlight housing and the spotlight device, and prestress the spotlight device in an axial direction onto the spotlight housing, or have a prestressing action in addition to the spring action of the spring element or holding element.

In this exemplary embodiment, the coil springs can be arranged between at least one surface, adjoining the lateral edge of the spotlight device, of the spotlight device and a flange arm of the spring element or holding element.

Alternatively, the coil springs are arranged between the fastening arms of two spring elements or holding elements fastened on the spotlight housing, there being angled away from the fastening arms two support arms that bear against the lateral edge of the spotlight device and from which flange arms bearing against the surface of the at least one spotlight device project, or the coil springs are arranged between the fastening lugs of spring elements or holding elements, there being angled away from the fastening lugs two support arms that bear against the lateral edge of the spotlight device and from which flange arms bearing against the surface of the at least one spotlight device project.

If the spotlight device comprises a reflector or a lens that is arranged at a spacing from a light source in the interior of the spotlight housing, the outer edge of the reflector or of the lens preferably rests on the spring arms of the spring elements, while the edge surface, adjacent to the outer edge, of the reflector or of the lens bears against a kink of the spring stops, designed as kinked leaf springs, of the spring elements.

BRIEF DESCRIPTION OF THE DRAWINGS

The idea on which the invention is based is to be explained in more detail with the aid of the connection illustrated in the figures of the drawing, of a) a single disk-shaped spotlight device in the form of a reflector or a lens, and b) two protective screens, mutually spaced apart axially, at the beam exit to the spotlight housing and/or a lens ring via spring elements mutually spaced apart at the circumference. In the drawing.

DETAILED DESCRIPTION

Figure 1:
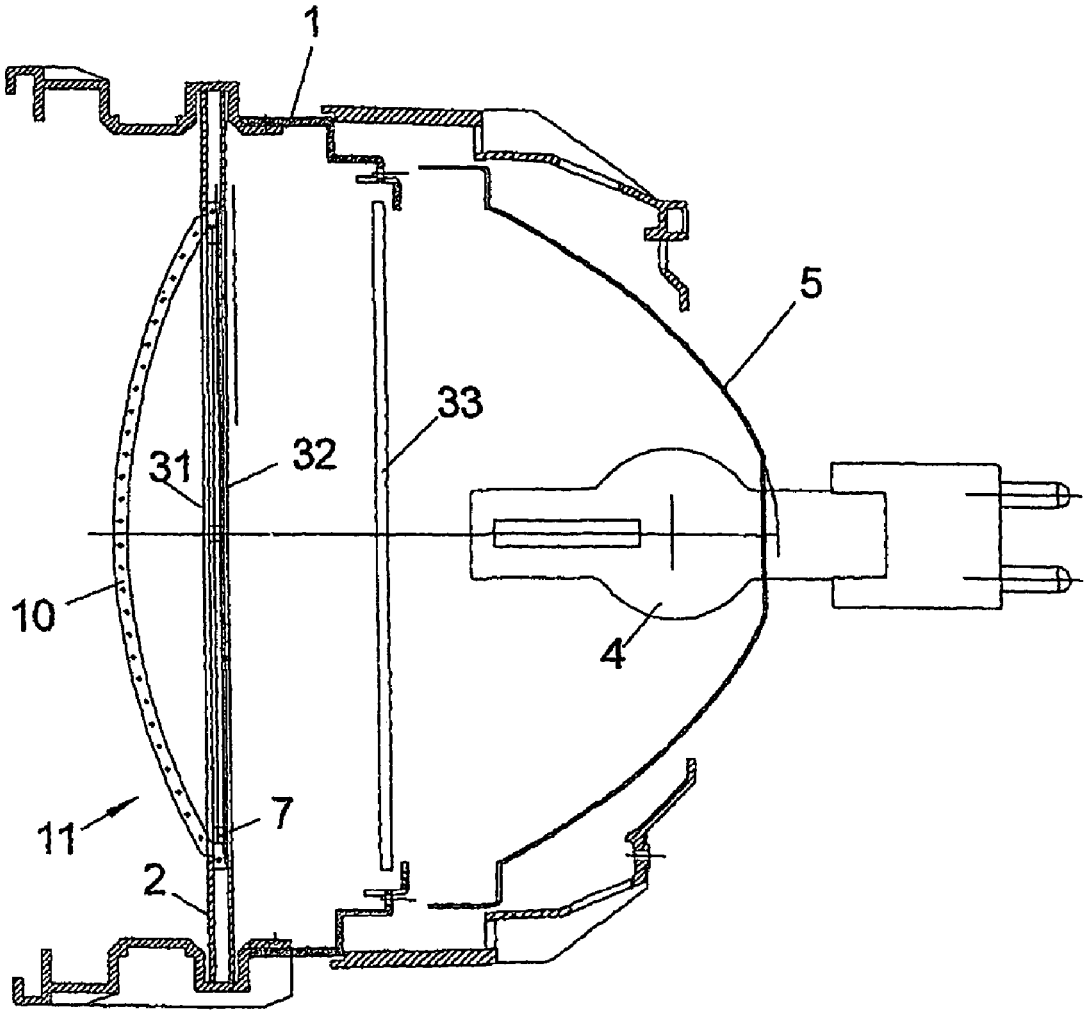
FIG. 1 shows a longitudinal section through an illuminating spotlight having a spotlight housing.

FIG. 1 shows a longitudinal section through an illuminating spotlight having a spotlight housing 1 whose beam exit opening 11 is sealed by a lens 10 and/or two protective screens 31, 32 arranged in a lens ring 2. Given an arrangement of a lens 10 at the beam exit opening 11 of the spotlight housing 1, it is possible for a single protective screen 33 to be arranged in the interior of the spotlight housing 1 and to be fastened on the spotlight housing 1. A reflector 5 is likewise arranged in the interior of the spotlight housing 1 and is fastened on the spotlight housing 1. A lamp 4 is arranged on the optical axis of the spotlight and plugged through the reflector 5.

The number and configuration of the spring elements is essentially a function of the type of spotlight device, of how the latter is supported on the spotlight housing and/or of a device, such as a lens ring, connected to the spotlight housing, of the requirement for radial and/or axial springing of the spotlight device with respect to the spotlight housing, and of the number of the spotlight devices to be held by the spring elements. In order to explain the invention, the following FIGS. describe the connection to the spotlight housing both of a single spotlight device in the form of a reflector, and of two intercoupled spotlight devices in the form of the two protective screens arranged at the beam exit opening of the spotlight housing.

The spring element 6, illustrated in FIGS. 2 to 5 in various views, for holding a reflector 5 illustrated in a cutout of its edge region, or an individual protective screen for sprung connection to the spotlight housing 1 of an illuminating spotlight in accordance with FIG. 1, is intended to serve as an example of the holding of an individual spotlight device. The spring element 6 has a fastening lug 60 from the top edge of which a web 66 projects at right angles. Angled away symmetrically to both sides from the web 66 in a circumferential direction of the reflector 5 are two spring arms 61, 62 that bear against the outer edge 50 of the reflector 5 and from the ends of which spring stops 63, 64 project and bear against one surface in the edge region of the reflector 5. The opposite surface in the edge region of the reflector 5 bears, for example, against a web 12 of the spotlight housing 1 that is circumferential or is partially directed into the interior of the illuminating spotlight.

At their ends, the spring arms 61, 62 have end webs 67, 68 that run essentially parallel to the web 66 and from which the spring stops 63, 64 are formed by renewed angling away. The spring stops 63, 64 have a kink 69 bearing against the surface of the edge region of the reflector 5, such that the spring stops 63, 64 bear against the surface of the reflector 5 in a punctiform or linear fashion.

Figure 2:
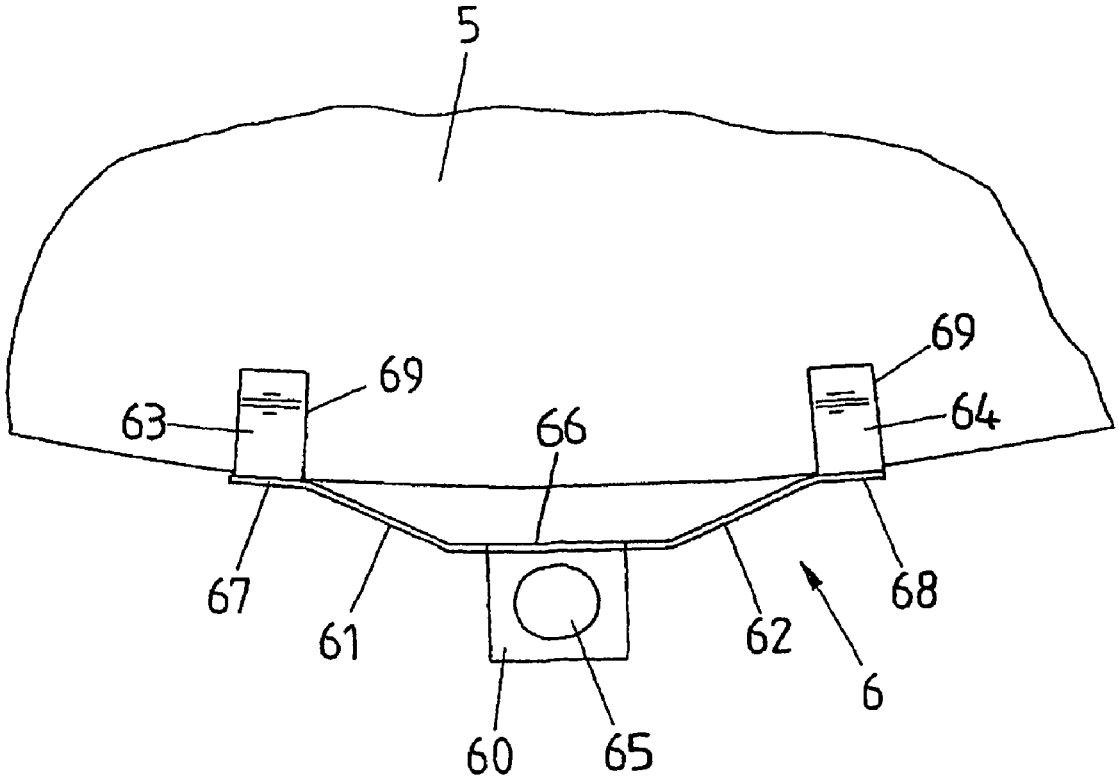
FIG. 2 shows a plan view of a cutout from the edge region of a reflector or a lens, having a spring element for sprung bearing of the reflector.
Figure 3:
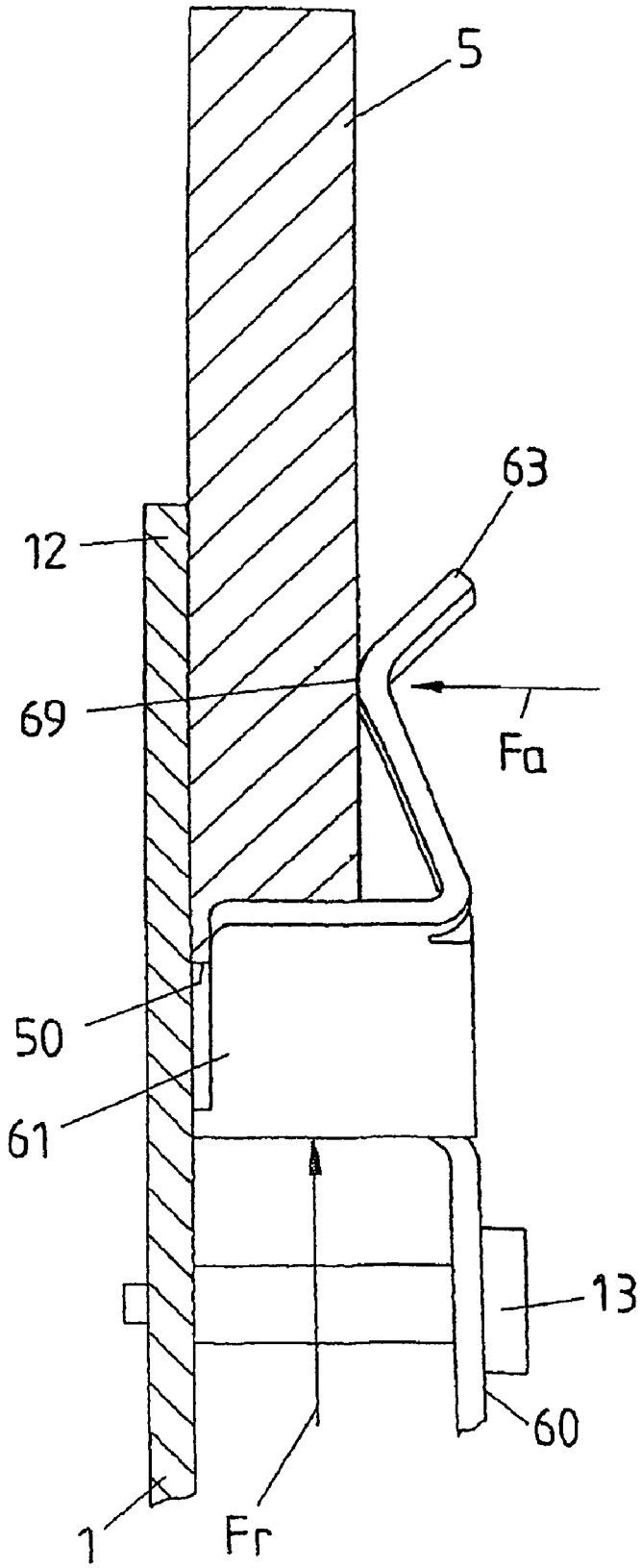
FIG. 3 shows a side view of the sprung reflector bearing in accordance with FIG. 1.
Figure 4:
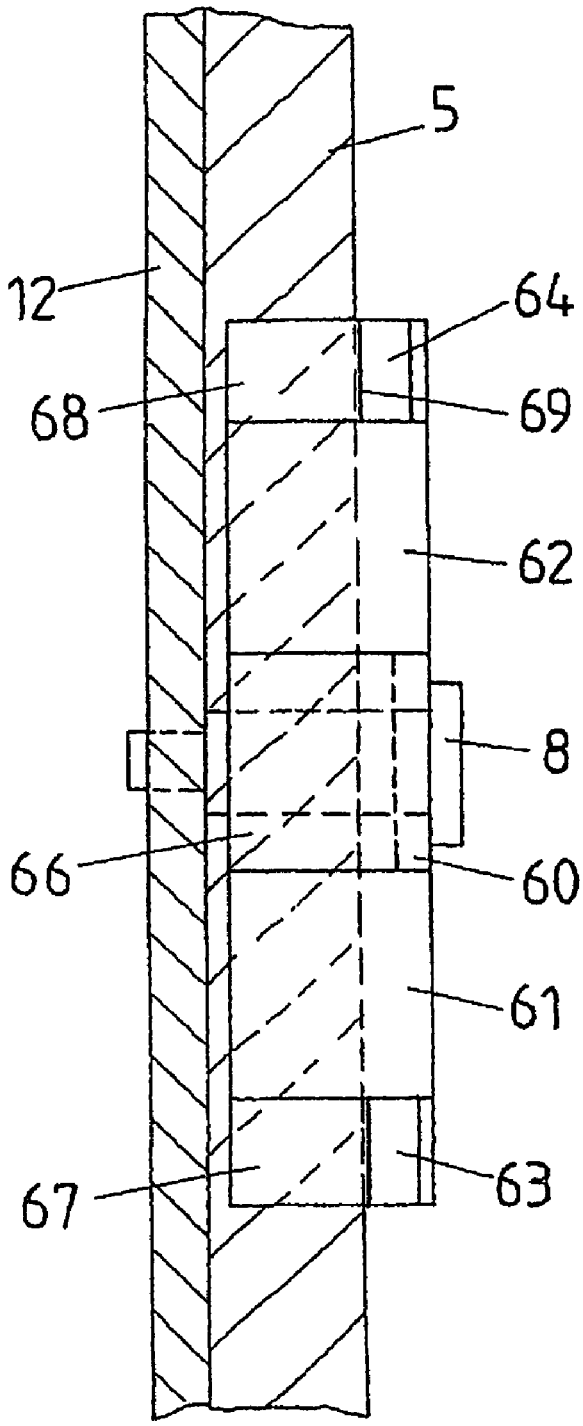
FIG. 4 shows a schematic plan view of the reflector bearing in accordance with FIGS. 2 and 3.

As is to be gathered from the various views in accordance with FIGS. 2 to 4, the spring element 6 can be formed or bent from a strip of suitable material so as to ensure simple, cost-effective production.

In order to connect the spring element 6 to the spot-light housing 1, the fastening lug 60 has a bore 65 through which a suitable fastening element 13, for example a screw, a pin or a rivet, can be plugged and connected to the spotlight housing 1.

As, in particular, the side view of the spring element 6 in accordance with FIG. 3 shows, the spring element 6 ensures springing of the reflector 5 along two axes, specifically in an axial and radial direction. This is illustrated symbolically in FIG. 3 by the arrow Fa for the axial springing, and by the arrow Fr for the radial springing.

Figure 5:
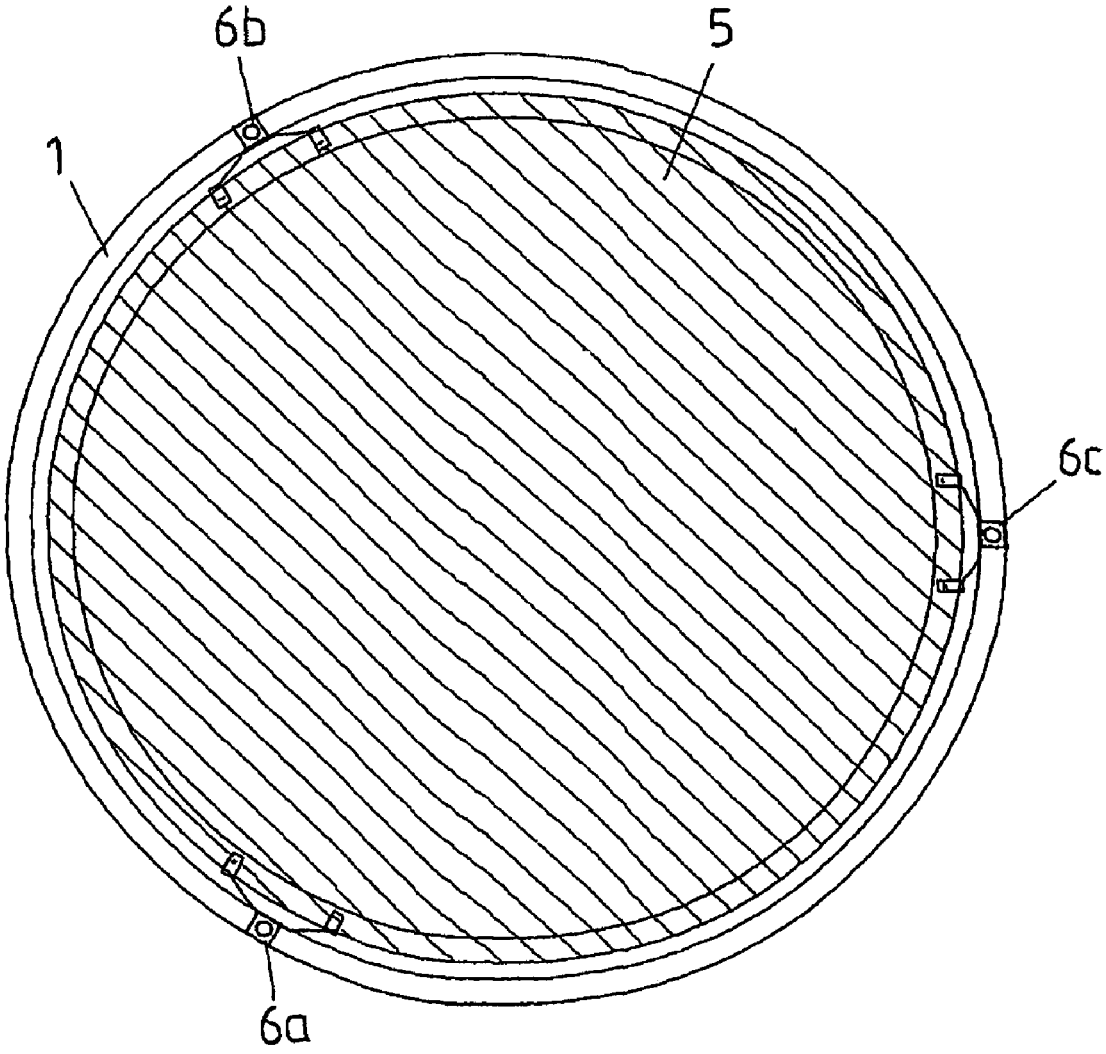
FIG. 5 shows a schematic plan view of a reflector fastened on a spotlight housing via three spring elements.
Figure 6:
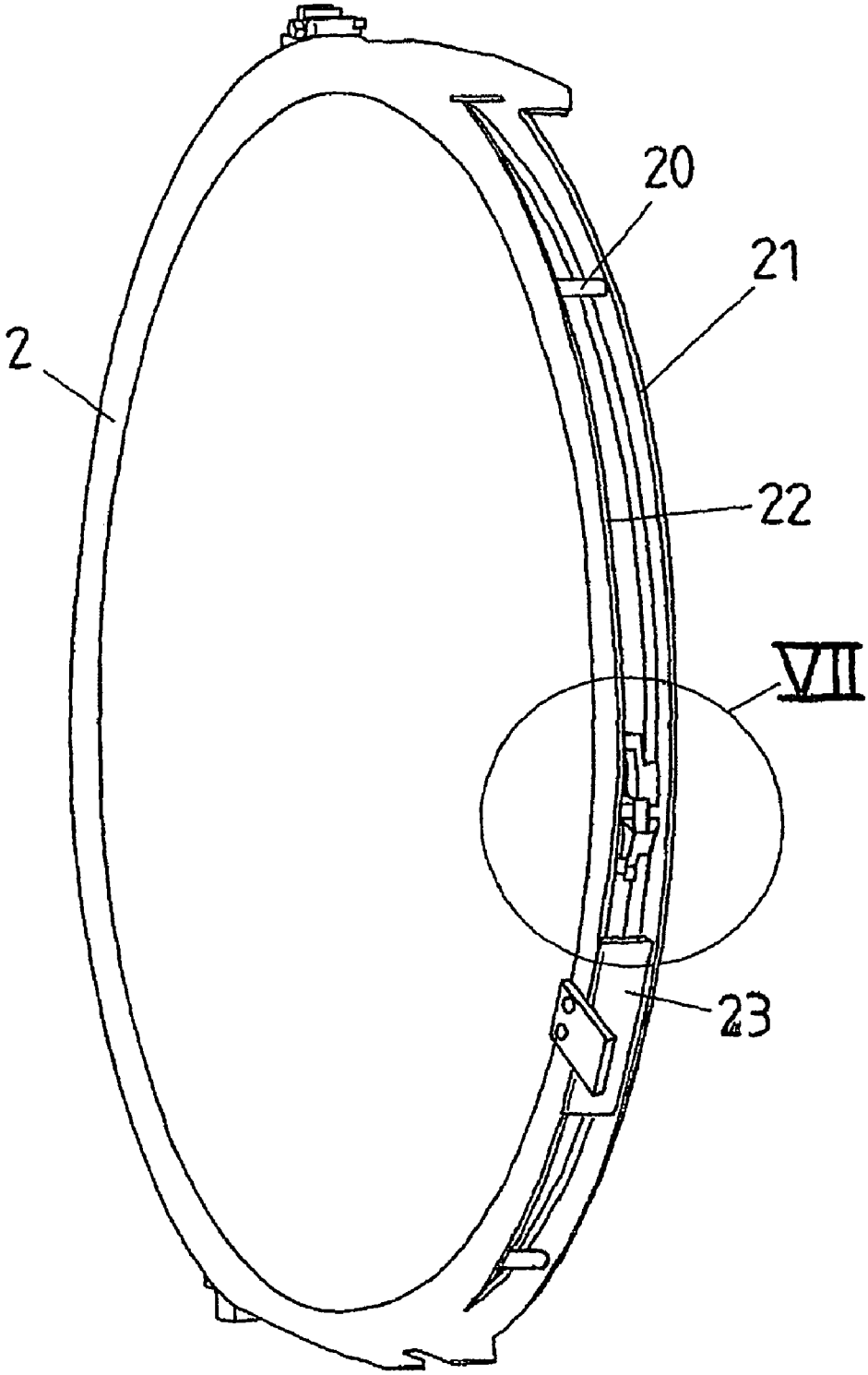
FIG. 6 shows a perspective view of two protective screens supported in a lens ring via spring elements.
Figure 7:
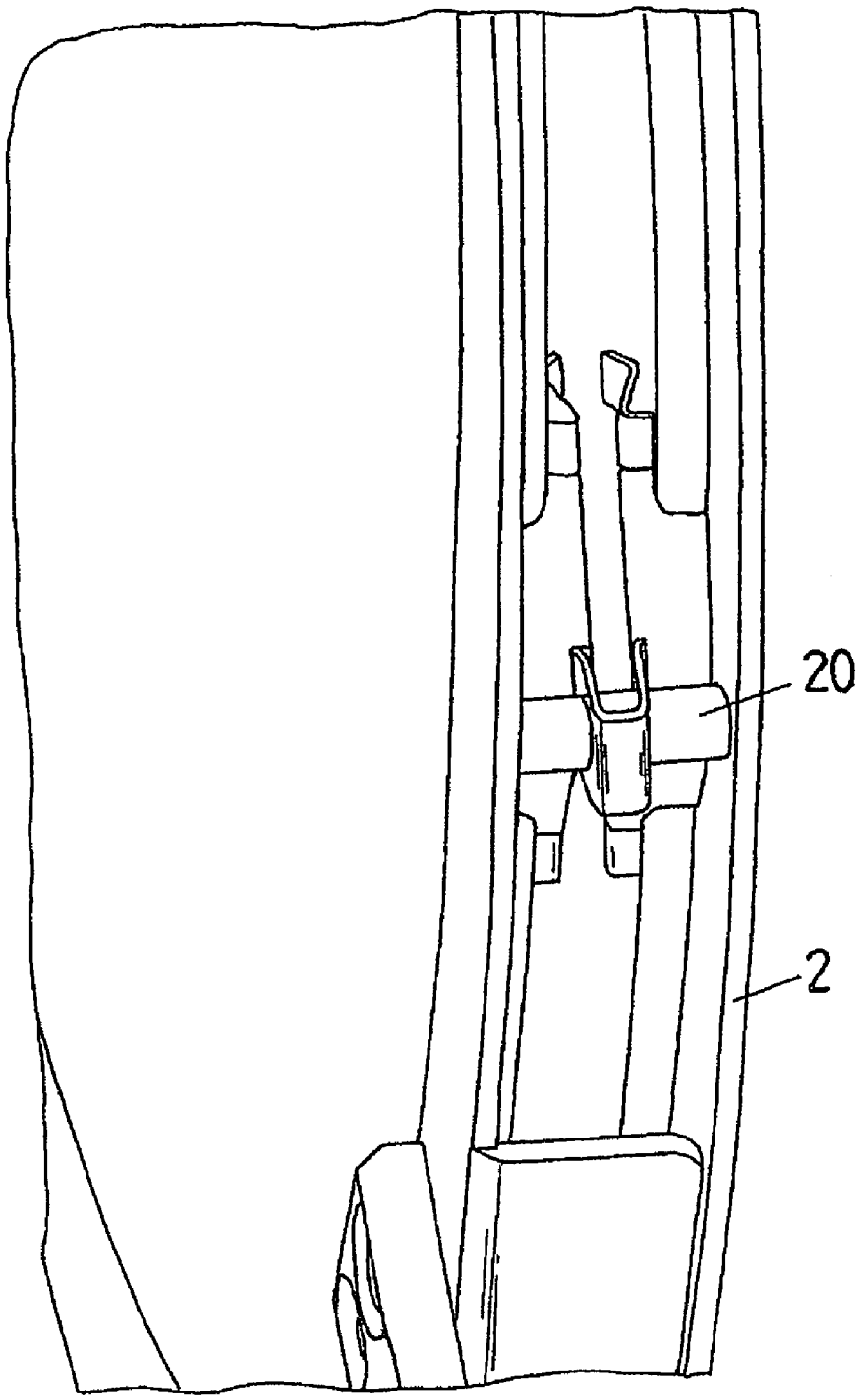
FIG. 7 shows an enlarged perspective illustration of the region VII in accordance with FIG. 6.

Owing to the arrangement of three spring elements 6*a*, 6*b*, 6*c* respectively offset from one another by approximately 120° on the circumference of the reflector 5, in accordance with FIG. 5 the reflector 5 is uniformly supported so as to ensure self-centering of the reflector 5, and thus an optimum alignment in relation to the optimum axis of the illuminating spot-light.

Owing to the springing of the spring element 6 in an axial direction, it is simultaneously ensured in this case that the reflector 5 bears permanently against the circumferential, or partially provided web 12 of the spotlight housing irrespective of temperature-induced expansions of the spotlight housing 1 and/or of the reflector 5.

If shocks or impacts act on the spotlight housing 1, the axial and radial springing of the reflector 5 with reference to the spotlight housing 1 prevents a maximum amount of protection against destruction and/or displacement of the reflector 5 from centering with reference to the optical axis of the illuminating spotlight.

As a further exemplary embodiment, FIGS. 6 to 9 illustrate the sprung bearing of two protective screens 31, 32 in spring elements 7 that are connected to a lens ring 2 which is connected to the spotlight housing 1 at the beam exit opening 11 of the spotlight housing 1.

The spring elements 7 are arranged in a fashion distributed over the circumference of the lens ring 2, for example in a fashion mutually offset by 120° in each case, and are located with spring arms 71, 71' and 72, 72' and spring stops 73, 73' and 74, 74' between the protective screens 31, 32 whose outwardly directed surfaces bear at their edge region against the circumferential webs 21, 22 of the lens ring 2.

Figure 8:
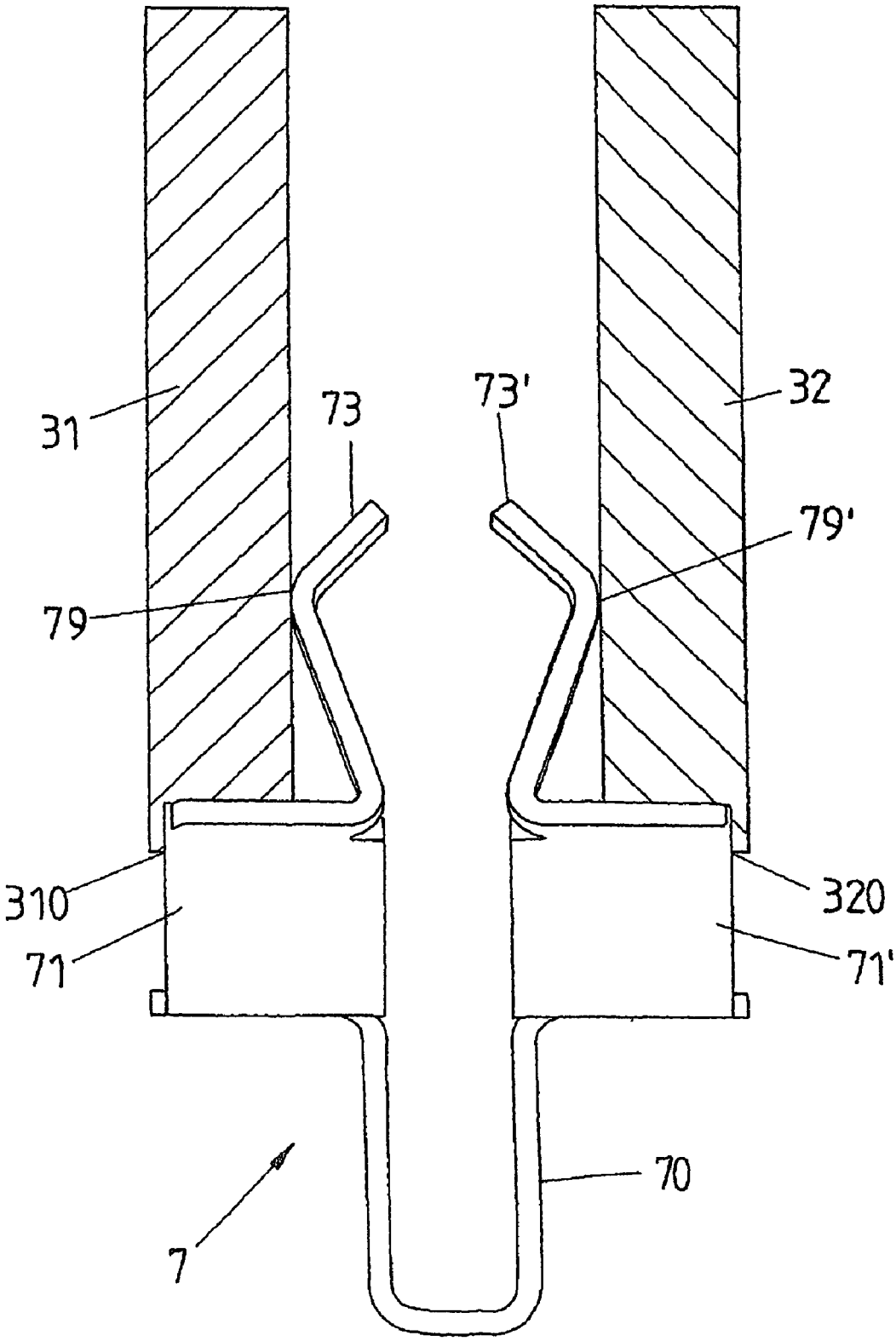
FIG. 8 shows a side view of a spring element for bearing the protective screens in accordance with FIGS. 6 and 7.
Figure 9:
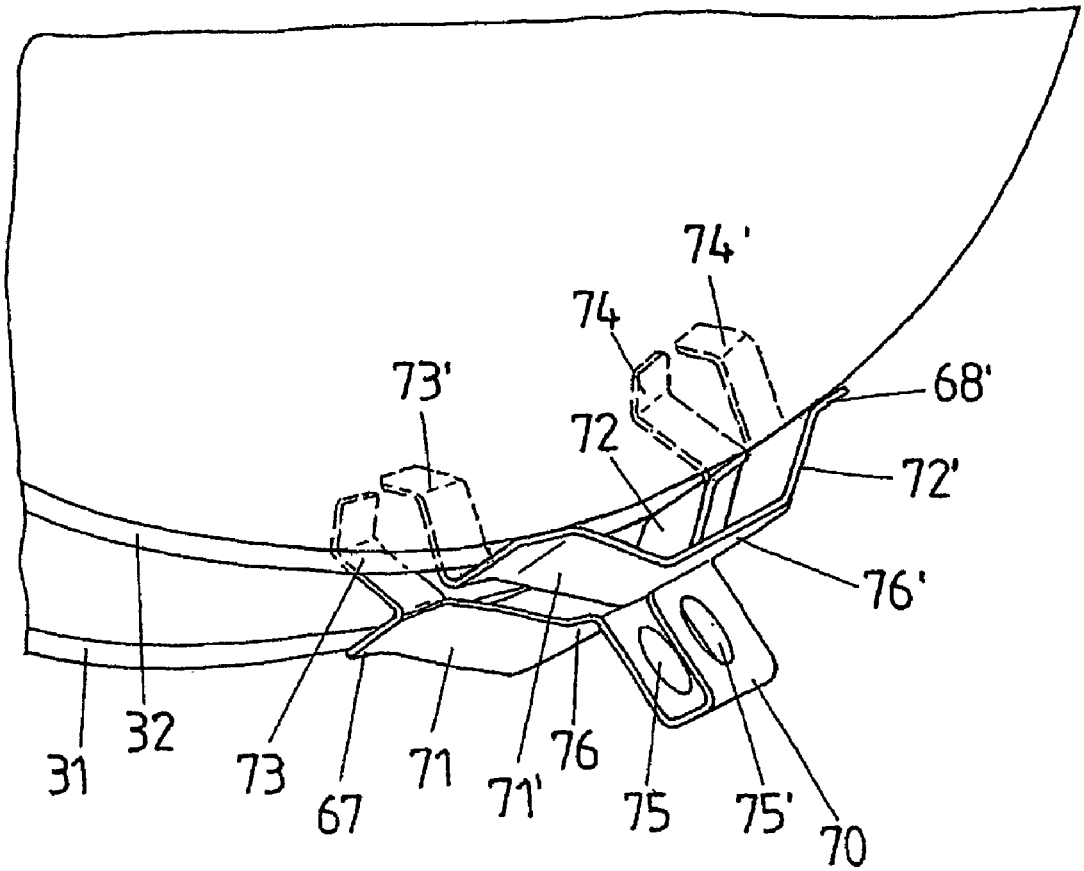
FIG. 9 shows a perspective view of the protective screens supported in a spring element, in accordance with FIG. 8.

As is to be gathered, in particular, from the side view in accordance with FIG. 8 and the perspective view in accordance with FIG. 9, the spring elements 7 are designed as two wings and have a U-shaped fastening lug 70 from whose top side, adjacent to the lateral edge 310, 320 of the protective screens 31, 32, there respectively projects at right-angles a web 76, 76' from which there are angled away to both sides in a circumferential direction of the protective screens 31, 32 spring arms 71, 71' and 72, 72' whose end regions 77, 78' merge into the spring stops 73, 73' and 74, 74', which are likewise angled away at right angles. The spring stops 73, 73' and 74, 74' have a kink 79, 79' that bears in a punctiform or linear fashion against the mutually facing surfaces of the edge region of the protective screens 31, 32.

The lateral edges 310, 320 of the protective screens 31, 32 rest on the end sections 67, 68' of the spring arms 71, 71' and 72, 72', and are therefore sprung in a radial direction with reference to the spotlight housing 1. The punctiform or linear bearing of the spring stops 73, 73' and 74, 74' ensures that the protective screens 31, 32 are supported in an axially sprung fashion such that the interspace formed between the protective screens 31, 32 is kept constant. At the same time, in conjunction with the radially sprung support of the protective screens 31, 32 via the ends of the spring arms 71, 71' and 72, 72' as well as the sprung bearing of the spring stops 73, 73' and 74, 74', the protective screens 31, 32 are assuredly protected against shocks or impacts that can act on the spotlight housing 1.

Arranged in a fashion distributed over the circumference of the lens ring 2 for the purpose of fastening the spring element 7 on the lens ring 2 are bolts 20 that are plugged through mutually aligned bores 75, 75' of the fastening lug 70 of the spring element 7. As is to be gathered from the perspective illustration in accordance with FIG. 6, in this case a part of the bolts 20 can serve for holding spring elements 7, while the remaining part of the bolts 20 serves for connecting the circumferential webs 21, 22 of the lens ring 2.

The shape of the spring elements 6, 7 illustrated in FIGS. 2 to 9 and described above is limited just as little to the exemplary embodiments described as their number, distributed at the circumference of the spot-light devices, of spring elements, or their connection to the spotlight devices. Thus, for example, the individual protective screen 33 in accordance with FIG. 1 can also be connected via a spring element 7 with a U-shaped fastening lug 70 to the spotlight housing 1 by arranging for the protective screen 33 to be held between the spring arms 71, 71'; 72, 72' and spring stops 73, 73'; 74, 74' by means of inwardly directed spring arms 71, 71' and 72, 72' and kinks 79, 79' of the spring stops 73, 73' and 74, 74'.

Figure 10:
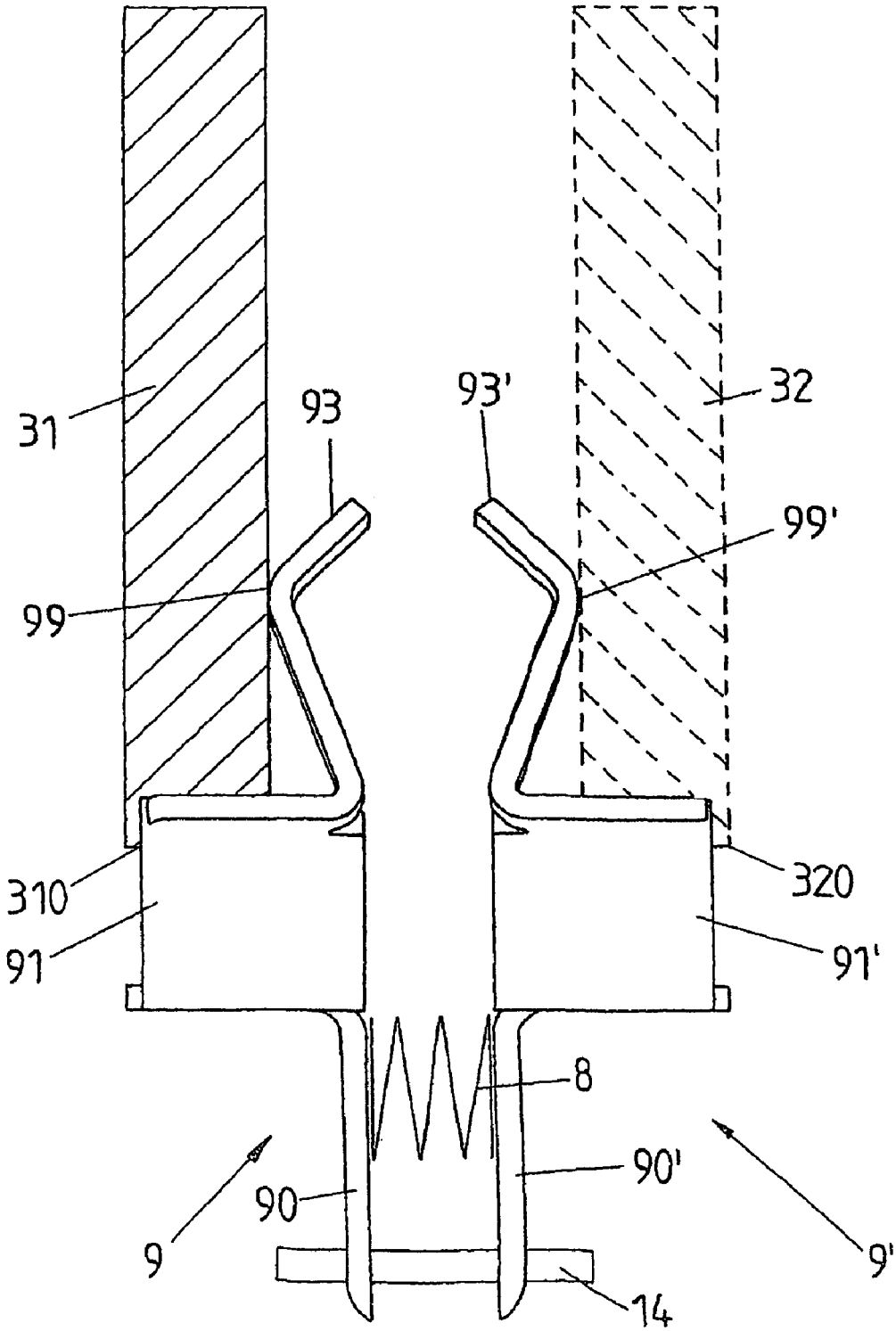
FIG. 10 shows a side view of two interconnected spring elements or holding elements that are fastened on the spotlight housing and between which and the surface of at least one protective screen a coil spring is arranged.

FIG. 10 shows a side view of a variant of the embodiment, illustrated in FIGS. 8 and 9, of the inventive solution, having two spring elements or holding elements 9, 9' that are supported via fastening arms 90, 90' on a pin 14 connected to the spotlight housing, and are prestressed against one another resiliently in an axial direction by means of a coil spring 8 arranged between the fastening arms 90, 90'. The spring elements or holding elements 9, 9' are substantially designed in a fashion similar to the spring elements described above with the aid of FIGS. 8 and 9, and have spring arms or support arms 91, 91' for holding the lateral edges 310, 320 of the protective screens 31, 32 as well as flange arms 93, 93' angled away therefrom that bear in a punctiform or linear fashion at a kink 99, 99' against the mutually facing surfaces of the edge region of the protective screens 31, 32.

In the embodiment in accordance with FIG. 10, one protective screen 31 is illustrated by full lines, while the other protective screen 32 is illustrated by dashed lines, in order to indicate that the arrangement illustrated in FIG. 10 can also be provided for a protective screen 31 of a spotlight device.

The spring elements or holding elements 9, 9' can optionally be of rigid design, and thus be designed as exclusively holding elements such that the coil springs 8 resiliently prestress the protective screens 31, 32 in an axial direction. Alternatively, the spring elements or holding elements 9, 9' can be of resilient design and thus for their part form spring elements that spring the protective screens 31, 32 in a radial direction, and their axially resilient action is reinforced by the coil spring 8 arranged between the fastening arms 90, 90' and which is active in an axial direction.

A further modification of the arrangement illustrated in side view in FIG. 10 consists in designing an individual spring element 9, with a spring element 7 designed by analogy with the embodiment in accordance with FIGS. 8 and 9, in a fashion having two wings with a U-shaped fastening lug 90 between which the coil spring 8 illustrated in FIG. 10 is arranged in order to support the spring action. In this embodiment, the U-shaped fastening lug 90 is likewise connected to the spotlight housing.

Figure 11:
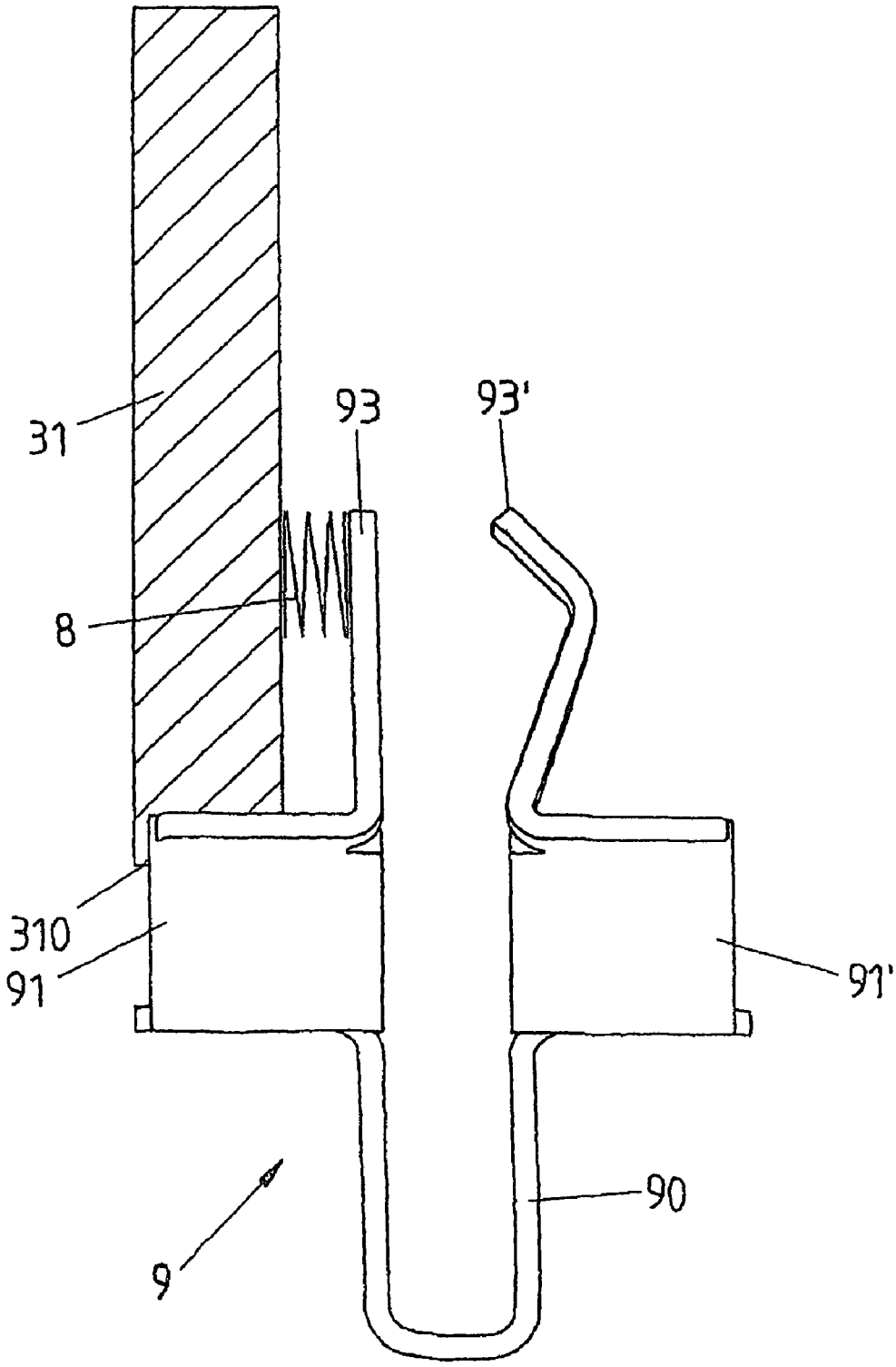
FIG. 11 shows a side view of a spring element or holding element fastened on the spotlight housing, between whose flange arm and the surface of a protective screen a coil spring is arranged.

Illustrated in a side view in FIG. 11 is a further variant of the inventive solution in the case of which instead of having the spring stops provided with a kink a spring element or holding element 9 designed in a fashion substantially to the spring element 7 in the embodiment in accordance with FIGS. 8 and 9 has at least one, preferably unkinked, flange arm 93 on which a coil spring 8 is supported and therefore springs the support screen 31 in an axial direction. The arm opposite the flange arm 93 can likewise be designed as a flat flange arm 93' or as a spring stop 93' with a kink, on which a second protective screen (not illustrated) is supported.

In this embodiment, as well, the spring element or holding element 9 can be designed as a spring element in accordance with the spring element 7 illustrated in FIGS. 8 and 9 and described above, such that when providing sprung support the coil springs 8 are provided for axial springing of the protective screens, or as rigid holding elements such that the axial springing is effected exclusively by the coil springs 8.

The invention claimed is:

1. An illuminating spotlight comprising a spotlight housing and a spotlight device connected to the spotlight housing, said device comprising a protective screen, spotlight lens, or reflector, wherein a lateral edge of said device is connected to the spotlight housing via spring elements arranged in a distributed fashion, the spring elements each having a fastening lug that is connected to the spotlight housing and from which there are angled away two spring arms which bear against the lateral edge of the spotlight device and are designed to be resilient in a radial direction of the spotlight housing, wherein spring stops of resilient design in an axial direction of the spotlight housing bear against at least one surface of the spotlight device and project from the spring arms, wherein the fastening lug has at least one bore for holding a fastening element connecting the spring element to the spotlight housing.

2. The illuminating spotlight of claim 1, wherein the spotlight device comprises a lens or a reflector that is arranged at a spacing from a light source in the interior of the spotlight housing, and wherein an outer edge of the lens or of the reflector rests on the spring arms of the spring elements, and an edge surface adjacent to the outer edge of the lens or of the reflector bears against a kink of the spring stops of the spring elements, wherein said spring stops are kinked leaf springs.

3. The illuminating spotlight of claim 1, wherein three spring elements arranged offset from one another by approximately 120° along the edge region of the spotlight device.

4. The illuminating spotlight of claim 1, wherein the spring arms are designed as leaf springs.

5. The illuminating spotlight of claim 1, wherein the spring stops are designed as leaf springs.

6. The illuminating spotlight of claim 1, wherein the spring arms or spring stops are designed as flat, kinked or bent leaf springs.

7. An illuminating spotlight comprising a spotlight housing and a spotlight device connected to the spotlight housing, said device comprising a protective screen, spotlight lens, or reflector, wherein a lateral edge of said device is connected to the spotlight housing via spring elements arranged in a distributed fashion, the spring elements each having a fastening lug that is connected to the spotlight housing and from which there are angled away two spring arms which bear against the lateral edge of the spotlight device and are designed to be resilient in a radial direction of the spotlight housing, wherein spring stops of resilient design in an axial direction of the spotlight housing bear against at least one surface of the spotlight device and project from the spring arms, wherein the spotlight device comprises two protective screens that are spaced apart from one another in the axial direction of the spotlight housing and whose edge regions rest at a circumference on the spring arms of said spring elements, wherein the fastening lugs of said spring elements are U-shaped, and wherein the spring stops are designed as kinked leaf springs and determine the axial spacing of the two protective screens from one another.

8. The illuminating spotlight of claim 7, wherein the edges of mutually facing surfaces of the protective screens respectively bear against a kink of the kinked leaf design spring stops.

9. The illuminating spotlight of claim 7, wherein the protective screens are arranged in a lens ring connected to the spotlight housing, and wherein the spring elements are arranged between the protective screens and press the edge regions of the protective screens against the lens ring.

10. An illuminating spotlight comprising a spotlight housing and a spotlight device connected to the spotlight housing, said device comprising a protective screen, spotlight lens, or reflector, wherein a lateral edge of said device is connected to the spotlight housing via spring elements or holding elements arranged in a distributed fashion, the spring elements or holding elements having fastening arms that are connected to the spotlight housing and from which there are angled away two support arms which bear against the lateral edge of the spotlight device and are designed to be resilient in a radial direction of the spotlight housing, wherein between the spring element or holding element connected to the spotlight housing and the spotlight device coil springs are disposed between the spring element or holding element and the spotlight device, wherein the coil springs prestress the spotlight device in an axial direction of the device onto the spotlight housing.

11. The illuminating spotlight of claim 10, wherein the coil springs are arranged between at least one surface of the spotlight device adjoining the lateral edge of the spotlight device and a flange arm of the spring element or holding element.

12. The illuminating spotlight of claim 10, wherein the coil springs are arranged between the fastening arms of two spring elements or holding elements fastened on the spotlight housing, there being angled away from the fastening arms two support arms that bear against the lateral edge of the spotlight device and from which flange arms bearing against the surface of the at least one spotlight device project.

13. The illuminating spotlight of claim 10, wherein the coil springs are arranged between the fastening lugs of the spring elements or holding elements, there being angled away from the fastening arms two support arms that bear against the lateral edge of the spotlight device and from which flange arms bearing against the surface of the at least one spotlight device project.

14. The illuminating spotlight of claim 10, wherein the spotlight device comprises a lens or a reflector that is arranged at a spacing from a light source in the interior of the spotlight housing, and wherein an outer edge of the lens or of the reflector rests on the spring arms of the spring elements, and an edge surface adjacent to the outer edge of the lens or of the reflector bears against a kink of the spring stops of the spring elements, wherein said spring stops are kinked leaf springs.

15. The illuminating spotlight of claim 10, wherein three spring elements arranged offset from one another by approximately 120° along the edge region of the spotlight device.

16. The illuminating spotlight of claim 10, wherein the spring arms or support arms are designed as leaf springs.

17. The illuminating spotlight of claim 10, wherein the spring stops or flange arms are designed as leaf springs.

18. The illuminating spotlight of claim 10, wherein the spring arms, support arms, spring stops or flange arms are designed as flat, kinked or bent leaf springs.

19. An illuminating spotlight comprising a spotlight housing and a spotlight device, the spotlight device comprising a protective screen, a lens or a reflector, said spotlight device having a lateral edge being composed of an outer circumferential edge and two edge surfaces adjacent to the outer edge, said lateral edge being connected to the spotlight housing via spring elements arranged in a distributed fashion around the lateral edge of the spotlight device, each of said spring elements having a fastening lug that is connected to the spotlight housing, two spring arms being designed as leaf springs, being angled away from said fastening lug and resiliently bearing against the outer edge of the spotlight device, and at least one spring stop protruding from said spring arms, said spring stop being designed as a kinked leaf spring, which is resiliently bearing against at least one edge surface of the spotlight device.

20. The illuminating spotlight of claim 19, wherein the fastening lug has at least one bore for holding a fastening element connecting the spring element to the spotlight housing.

21. The illuminating spotlight of claim 19, wherein the spotlight device comprises two protective screens that are spaced apart from each other in their axial direction and which comprise edge regions which rest on the spring arms of said spring elements, and wherein two spring stops determine the axial spacing of the two protective screens from each other.

22. The illuminating spotlight of claim 21, wherein the edges of mutually facing surfaces of the protective screens respectively bear against a kink of the kinked leaf spring stops.

23. The illuminating spotlight of claim 21, wherein the protective screens are arranged in a lens ring connected to the spotlight housing, and wherein the spring elements are arranged in between the protective screens and press the edge regions of the protective screens against the lens ring.

24. An illuminating spotlight comprising a spotlight housing and a spotlight device, the spotlight device comprising a protective screen, a lens or a reflector, said spotlight device having a lateral edge being composed of an outer edge and two edge surfaces adjacent to the outer edge, said lateral edge being connected to the spotlight housing via spring elements arranged in a distributed fashion around the lateral edge of the spotlight device, each of said spring elements having a fastening arm which is connected to the spotlight housing, and two support arms, being designed as leaf springs, being angled away from said fastening arm and resiliently bearing against the outer edge of the spotlight device, and one or more coil springs being disposed between the spring elements and the spotlight device, said coil springs being arranged to prestress the spotlight device in an axial direction of the device onto the spotlight housing.

25. The illuminating spotlight of claim 24, wherein the coil springs are arranged between at least one surface of the spotlight device, adjoining the lateral edge of the spotlight device, and a fastening arm of the spring element.

26. The illuminating spotlight of claim 24, wherein the coil springs are arranged in between the fastening arms of two of the said spring elements fastened on the spotlight housing, there being angled away from the fastening arms two support arms that bear against the lateral edge of the spotlight device and from which flange arms protrude, which are bearing against the surface of the at least one spotlight device.

27. The illuminating spotlight of claim 19 or 24, wherein three spring elements arranged offset from each other by approximately 120° along the edge region of the spotlight device.

28. The illuminating spotlight of claim 19 or 24, wherein the spring arms, support arms or flange arms are designed as flat, kinked or bent leaf springs.

* * * * *